US005888949A

United States Patent [19]

Cole et al.

[11] Patent Number: 5,888,949

[45] Date of Patent: Mar. 30, 1999

[54] COMPOSITION FOR CLEANING TEXTILE DYEING MACHINES

[75] Inventors: Howard Cole; Brian Francois, both of Charlotte, N.C.

[73] Assignee: Henkel Corporation, Gulph Mills, Pa.

[21] Appl. No.: 781,160

[22] Filed: Jan. 8, 1997

Related U.S. Application Data

[60] Provisional application No. 60/013,048 Mar. 8, 1996.

[51] Int. Cl.[6] ..... C11D 1/835; C11D 1/62; C11D 1/72; C11D 3/22

[52] U.S. Cl. ..... 510/109; 510/422; 510/423; 510/433; 510/435; 510/470; 510/502; 510/504; 510/513

[58] Field of Search ..... 510/470, 504, 510/433, 109, 421, 422, 423, 435, 245, 272, 254, 513, 535, 502; 252/239, 199

[56] References Cited

U.S. PATENT DOCUMENTS

| | | | |
|---|---|---|---|
| 4,228,044 | 10/1980 | Cambre | 510/347 |
| 4,386,000 | 5/1983 | Turner et al. | 510/526 |
| 4,493,773 | 1/1985 | Cook et al. | 510/331 |
| 4,606,850 | 8/1986 | Malik | 510/420 |
| 4,804,497 | 2/1989 | Urfer et al. | 510/292 |
| 5,109,127 | 4/1992 | Sekiguchi et al. | 536/115 |
| 5,174,927 | 12/1992 | Honsa | 252/543 |
| 5,190,747 | 3/1993 | Sekiguchi et al. | 424/56 |
| 5,223,179 | 6/1993 | Connor et al. | 252/548 |
| 5,310,542 | 5/1994 | Au et al. | 424/52 |
| 5,330,674 | 7/1994 | Urfer et al. | 510/384 |
| 5,332,528 | 7/1994 | Pan et al. | 252/548 |
| 5,338,491 | 8/1994 | Connor et al. | 252/548 |
| 5,352,387 | 10/1994 | Rahman et al. | 252/548 |
| 5,358,656 | 10/1994 | Humphreys et al. | 252/174 |
| 5,534,248 | 7/1996 | Matsuo et al. | 424/70.28 |
| 5,576,284 | 11/1996 | Van Buskirk et al. | 520/384 |
| 5,627,144 | 5/1997 | Urfer et al. | 510/188 |

FOREIGN PATENT DOCUMENTS

| | | |
|---|---|---|
| 550279 | 12/1992 | European Pat. Off. . |
| 550280 | 12/1992 | European Pat. Off. . |
| 550281 | 12/1992 | European Pat. Off. . |

OTHER PUBLICATIONS

U.S. S.I.R. H269, Malik, May 1987.

*Primary Examiner*—Ardith Hertzog
*Attorney, Agent, or Firm*—Ernest G. Szoke; Wayne C. Jaeschke; Steven J. Trzaska

[57] ABSTRACT

A cleaning additive containing (a) from about 8 to about 16% by weight of a nonionic sugar surfactant selected from the group consisting of alkyl glucose esters, aldobionamides, gluconamides, glyceramides, glyceroglycolipids, polyhydroxy fatty acid amides, an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof; (b) from about 3 to about 7% by weight of a $C_8$–$C_{16}$ quaternary ammonium salt; and (c) remainder water, all weights being based on the weight of the additive.

27 Claims, No Drawings

COMPOSITION FOR CLEANING TEXTILE DYEING MACHINES

This application claims priority of earlier filed provisional application Ser. No. 60/013,048, filed on Mar. 8, 1996.

FIELD OF THE INVENTION

The present invention generally relates to a composition and process for cleaning textile dyeing machines. More particularly, the present invention provides a high foaming composition and process for effectively removing dyes and other waste contaminants from the interior walls of textile drying machines.

BACKGROUND OF THE INVENTION

Textile materials are among the most ubiquitous in society. They provide shelter and protection from the environment in the form of apparel, and comfort and decoration in the form of household textiles, such as sheets, upholstery, carpeting, drapery and wall covering, and they have a variety of industrial functions, such as tire reinforcement, tenting, filter media, conveyor belts, insulation, etc.

Textile materials are produced from fibers (finite lengths) and filaments (continuous lengths) by a variety of processes to form woven, knitted and nonwoven (felt-like) fabrics. In the case of woven and knitted fabrics, the fibers and filaments are formed into intermediate continuous-length structures known as yarns, which are interlaced by weaving or interlooped by knitting into planar-flexible sheetlike structures known as fabrics. Nonwoven fabrics are formed directly from fibers and filaments by chemically or physically bonding or interlocking fibers that have been arranged in a planar configuration.

Textile fibers are classified into two main categories, man-made and natural. Man-made fibers are formed by extrusion processes known as melt-dry, or wet spinning. The spinning or extrusion of filaments is normally followed by an operation known as drawing. In this step, the newly formed filaments are irreversibly extended and stabilized by setting or crystallization processes.

With the exception of silk, naturally occurring fibers have finite lengths and generally require several cleaning and purification steps prior to processing into yarns and fabrics. There are a number of finishing processes that textile fibers are subjected to after their formation wherein chemical compounds are applied onto the fibers. Examples include dyeing, waterproofing and the like. According to these types of processes, the textile substrate is typically placed into a closed-system apparatus known as a kier which is a large drum or barrel connected to recirculation pump. A finishing liquor, whether it be a dye or some other textile finish, is placed into the drum or barrel followed by insertion of the textile substrate. The apparatus is then closed and the recirculation pump activated. Since the system is closed and, hence, under pressure, as the finishing liquor is recirculated by the pump through the drum/barrel, the finishing liquor adheres itself to the fibers. Thus, in the event a dye is used as the finishing liquor, the kier enables the dye to adhere to the textile fibers, thereby imparting a desired color thereto.

Once a certain run of textile yarns or fabrics has been dyed, the interior of the barrel/drum (kier) typically needs to be cleaned prior to the next dyeing. The application of colored dye requires the complete removal of any residue of the old dye liquor, as well as any contaminants that may have been formed in the drum/barrel (kier) during the treating process. It is to this aspect of the textile treating process that the present invention is directed.

While cleaning compounds are presently being used to clean the interior walls and/or circulation lines of textile finishing apparatuses, due to the many nooks and crannies found in these types of systems where excess finishing liquors and contaminants can adhere to, coupled with the necessity that all remnants of a prior treating process be completely removed so as not to interfere with a subsequent finishing process, known cleaning compounds have proven to be somewhat ineffective due to their inability to reach into and clean all of these nooks and crannies.

SUMMARY OF THE INVENTION

The present invention is directed to a cleaning additive for use in cleaning interior surfaces of a textile treating apparatus, the additive containing:

(a) from about 8 to about 16% by weight of a nonionic sugar surfactant selected from the group consisting of alkyl glucose esters, aldobionamides, gluconamides, glyceramides, glyceroglycolipids, polyhydroxy fatty acid amides, an alkyl polyglycoside of formula I:

$$R_1O\ (R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(b) from about 3 to about 7% by weight of a $C_8$–$C_{16}$ quaternary ammonium salt, all weights being based on the weight of the additive; and (c) remainder water.

The present invention is also directed to a cleaning composition containing (a) the above-disclosed cleaning additive, (b) an alkali, and (c) water in a ratio by weight of (a):(b):(c) ranging from about 1:1:25 to about 1:1:50.

The present invention is also directed to a process for cleaning an interior surface of a textile treating apparatus involving contacting the interior surface with the above-disclosed cleaning composition.

DESCRIPTION OF THE INVENTION

Other than in the operating examples, or where otherwise indicated, all numbers expressing quantities of ingredients or reaction conditions are to be understood as being modified in all instances by the term "about".

The term nonionic sugar surfactant as used herein refers to surfactants that are based on saccharide moieties. The nonionic sugar surfactants which may be employed in the present invention are selected from the group consisting of alkyl polyglycosides, alkyl glucose esters, aldobionamides, gluconamides, glyceramides, glyceroglycolipids, polyhydroxy fatty acid amides, and mixtures thereof.

Preferred alkyl polyglycosides which can be used as the complexing agent in the concentrate of the invention have the formula I:

$$R_1O(R_2O)_b(Z)_a \qquad \text{I}$$

wherein Z is a glucose residue and b is zero. Such alkyl polyglycosides are commercially available, for example, as GLUCOPON®, or PLANTAREN® surfactants from Henkel Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.6.
3. GLUCOPON® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.6.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated. The alkyl polyglycoside of the present invention acts as the complexing agent for the iodine complex concentrate.

The alkyl glucose ester sugar surfactants are generally disclosed in U.S. Pat. Nos. 5,109,127 and 5,190,747 the entire contents of both of which are incorporated herein by reference. These sugar surfactants have the general formula II:

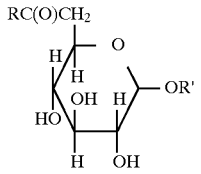

wherein R represents a fatty acid residue of 6 to 20 carbon atoms, preferably 6 to 12 carbon atoms and $R^1$ represents an alkyl group having 2 to 6 carbon atoms. Representative examples of such alkyl glucose esters are 1-ethyl-6-caprylglucoside, 1-ethyl-6-caprylglucoside, 1-butyl-6-caprylglucoside, 1-ethyl-6-palmitylglucoside and 1-ethyl-6-oleylglucoside.

The aldobionamide sugar surfactants are generally disclosed in U.S. Pat. No. 5,310,542 and in published European Patent Application No. 550,281 both of which are incorporated herein by reference. An Aldobionamide is generally defined as the amide of an aldobionic acid or aldobionolactone and an aldobionic acid in turn is defined as a sugar substance (e.g. any cyclic sugar) in which the aldehyde group has been replaced by a carboxylic acid which upon drying is capable of cyclizing to form an aldonolactone. The aldobionamides can be based on compounds comprising two saccharide units, e.g. lactobionamides, maltobionamides, cellobionamides, melibionamides, or gentiobionamides, or they can be based on compounds comprising more than two saccharide units provided that the polysaccharide has a terminal sugar unit with an aldehyde group available.

The preferred aldobionamides of the present invention are lactobionamides of the formula III:

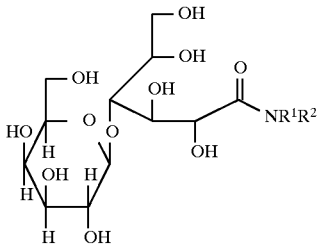

wherein $R^1$ and $R^2$ are the same or different and are selected from hydrogen and an aliphatic hydrocarbon radical containing up to about 36 carbon atoms (e.g. alkyl groups and alkenyl groups which groups may also include a heteroatom such as N, O, S, present, for instance, as an amide, carboxy, ether and/or saccharide moiety) except that $R^1$ and $R^2$ cannot simultaneously be hydrogen. The aliphatic hydrocarbon radical preferably contains up to 24 carbon atoms, most preferably from 8 to 18 carbon atoms. Representative examples of such lactobionamides are N-propyl lactobionamide, N-pentyl lactobionamide, N-decyl lactobionamide, N-hexadecyl lactobionamide, N-oleyl lactobionamide, N-dodecyl-N-methyl lactobionamide, and N-dodecyloxypropyl lactobionamide.

The gluconamide sugar surfactants are generally disclosed in U.S. Pat. No. 5,352,386 the entire contents of which is incorporated herein by reference. These surfactants have the general formula IV:

$$HOCH_2—(CHOH)_m—C(O)—NHR$$

wherein m is an integer from 2 to 5; and R is a straight or branched, saturated or unsaturated aliphatic hydrocarbon having 4 to about 24 carbon atoms, preferably 8 to 24 carbon atoms, which R group can also contain a heteroatom selected from the group consisting of oxygen, nitrogen and sulfur. Representative examples of such cosurfactants are N-octylerythronamide, N-decylerythronamide, N-dodecylerythronamide, N-tetradecylerythronamide, N-decylxylonamide and N-dodecylxylonamide.

The glyceramide sugar surfactants are generally disclosed in U.S. Pat. No. 5,352,387 the entire contents of which is incorporated herein by reference. These cosurfactants have the general formula V:

$$HOCH_2CH(OH)C(O)NHR$$

wherein R is a $C_8$ to $C_{24}$ straight or branched chained, saturated or unsaturated aliphatic hydrocarbon in which the R group may also be substituted by a heteroatom selected from oxygen, nitrogen and sulfur. Representative examples of such cosurfactants are N-octylglyceramide, N-decylglyceramide and N-hexadecylglyceramide.

The glyceroglycolipid sugar surfactants are generally disclosed in U.S. Pat. No. 5,358,656, and published European Patent Application No. 550,279 the disclosure of each of which is incorporated herein by reference. The glycero-glycolipids can be of the formula VI:

$$A^1—O—CH_2—CH(B)—CH_2NRR_1$$

wherein $A^1$ is a saccharide, preferably having one or more saccharide units, more preferably a mono or disaccharide and most preferably a monosaccharide such as glucose or galactose; R and $R_1$ are the same or different and are hydrogen, a branched or unbranched hydrocarbon radical having from 1 to about 24, preferably from about 6 to about 18 carbon atoms; B is OH or a $NR^2R^3$ group, wherein $R^2$ and $R^3$ may be the same or different and are hydrogen, a branched or unbranched hydrocarbon radical having 1 to 24, preferably from 6 to 18 carbon atoms, and $NRR_1$ and B are positionally interchangeable. Representative examples of such cosurfactants are 3-(butylamino)-2-hydroxypropyl-β-D-galactopyranoside, 3-(octylamino)-2-hydroxypropyl-β-D-galactopyranoside, 3-(eicosylamino)-2-hydroxypropyl-β-D-galactopyranoside, 3-(butylamino)-2-hydroxypropyl-β-D-glucopyranoside, and 3-(pentylamino)-2-hydroxypropyl-β-D-mannopyranoside.

Other glyceroglycolipid surfactants are disclosed in published European Patent Application No. 550,280 which is incorporated herein by reference. These cosurfactants are of the formula VII:

$$A^1—O—CH_2—CH(OR_1)—CH_2OR$$

wherein $A^1$ is from 1 to 4 saccharide units and more preferably represents a mono or disaccharide, and most preferably a monosaccharide, for example, glucose or galactose; R and $R_1$ are the same or different and are hydrogen, or a branched or unbranched, saturated or unsaturated, hydrocarbon radical having from 1 to 24 carbon atoms, preferably from 6 to 18 carbon atoms. Representative examples of such cosurfactants are 3-(butyloxy)-2-hydroxypropyl-β-D-galactopyranoside, 3-(eicosyloxy)-2-hydroxypropyl-β-D-galactopyranoside, 3-(decyloxy)-2-hydroxypropyl-β-D-galactopyranoside, 3-(butyloxy)-2-hydroxypropyl-β-D-glucopyranoside, 3-(octyloxy)-2-hydroxypropyl-β-D-mannopyranoside, 3-(tetradecyloxy)-2-hydroxypropyl-β-D-lactoside, 3-(octadecyloxy)-2-hydroxypropyl-β-D-maltoside, 3-(octyloxy)-2-hydroxypropyl-β-D-galactotrioside, and 3-(dodecyloxy)-2-hydroxypropyl-β-D-cellotrioside.

The polyhydroxy fatty acid amide sugar surfactants are generally disclosed in U.S. Pat. Nos. 5,174,927, 5,223,179 and 5,332,528 the entire disclosure of each of which is incorporated herein by reference. The polyhydroxy fatty acid amide surfactant component of the present invention comprises compounds of the structural formula VIII:

$$R^2C(O)N(R^1)Z$$

wherein: $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In the above Formula $R^1$ can be, for example, N-methyl, N-ethyl, N-propyl, N-isopropyl, N-butyl, N-2-hydroxy ethyl, or N-2-hydroxy propyl.

$R^2C(O)N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Representative examples of such surfactants are N-methyl-N-1-deoxyglucityl cocoamide and N-methyl-N-1-deoxyglucityl tallowamide.

Other suitable polyhydroxy fatty acid amide surfactants (see U.S. Pat. Nos. 5,223,179 and 5,338,491, the entire contents of each which are incorporated herein by reference) are those of the formula IX:

$$RC(O)N(R^1)CH_2CH(OH)CH_2OH$$

wherein R is a $C_7$–$C_{21}$ hydrocarbyl species, i.e. coconut, tallow, palm fatty alkyl and oleyl, and $R^1$ is a $C_1$ to $C_6$ hydrocarbyl or substituted hydrocarbyl species, i.e. N-alkyl-N-(1,2-propanediol) and N-hydroxyalkyl-N-1,2-propane diol fatty acid amides. Representative examples of such cosurfactants are the tallow amide of 3-[2-(hydroxyethyl) amino]-1,2-propanediol (HEAPD), the palmitate amide of 3-methylamino-1,2-propanediol (MAPD) and the lauramide of MAPD.

The presence of a nonionic sugar surfactant provides for the formation of significant level of foam, upon agitation, whereby the foam effectively penetrates into all of the nooks and crannies present inside the textile treating machine, while simultaneously carrying additional detersive components thereto.

A particularly preferred nonionic sugar surfactant is an alkyl polyglycoside of formula I wherein $R_1$ is a monovalent organic radical having from 8 to 16 carbon atoms, b is zero, and a is number having a value of 1.6.

The quaternary ammonium salt is used to impart additional detersive properties to the cleaning additive. For example, if polyester-containing textile fibers are treated with a particular textile finish, such as a dye, contaminants in the form of polyester trimers will have a tendency to adhere to the interior surfaces of the textile treating apparatus. Efficient cleaning of the apparatus, prior to initiating another run, requires the removal of these types of contaminants. Thus, the use of $C_8$–$C_{16}$ quaternary ammonium salts enables the removal of these types of contaminants. A particularly preferred quaternary ammonium salt is cocodimethyl ammonium chloride.

According to one aspect of the present invention, there is provided an aqueous cleaning additive for use in cleaning the interior surfaces of a textile treating apparatus such as, for example, a kier, wherein the aqueous cleaning additive contains (a) from about 8 to about 16, and preferably about 12% by weight of a nonionic sugar surfactant, preferably an alkyl polyglycoside, (b) from about 3 to about 7, and preferably about 5% by weight of a quaternary ammonium salt, preferably a cocodimethyl ammonium chloride, and (c) remainder water, all weights being based on the weight of the additive.

Auxilliaries intended to further enhance the functional properties of the cleaning additive of the present invention may also be employed on an as needed basis. For example, the addition of an emulsifier/wetting agent may be desired in certain instances. One example of a suitable emulsifier/wetting agent is a polyethylene glycol having from about 8 to about 12 moles of ethylene oxide. A particularly preferred emulsifier/wetting agent is tridecyl alcohol having 12 moles of ethylene oxide. If used, the auxilliaries will be present in the additive in an amount ranging from about 5 to about 10, and preferably about 7.5% by weight, based on the weight of the additive.

According to another aspect of the invention, there is provided a cleaning composition for use in cleaning the interior surfaces of a textile treating apparatus. The composition contains the above-disclosed cleaning additive, an alkali and water, in a ratio by weight of from about 1:1:25 to about 1:1:50, respectively. Examples of suitable alkalis which may be used include, but are not limited to, caustic soda and sodium hydrosulfate.

In another embodiment of the invention, there is provided a process for cleaning interior surfaces of a textile treating apparatus, such as a kier. The process involves contacting the interior surfaces of the textile treating apparatus with the above-disclosed cleaning composition.

The present invention will be better understood from the examples which follow, all of which are meant to be illustrative only and are not meant to unduly limit the scope of the invention. Unless otherwise indicated, percentages are on a weight-by-weight basis.

EXAMPLE I

A cleaning additive was prepared according to the following formulation:

| Component | % by wt. |
|---|---|
| (a) GLUCOPON ® 425 | 12.0 |
| (b) UNIQUAT ® QAC 50 | 5.0 |
| (c) TRYCOL ® 5943 | 7.5 |
| (d) water | 75.5 |
| | 100.0 |

To each 100 gallons of water that was poured into a closed-system kier containing excess dyes and contaminants on the interior surfaces thereof, was added two pounds each of both the above-disclosed cleaning additive and a 50% active caustic soda to form a cleaning composition in accordance with the present invention. The cleaning composition was heated to a temperature of from about 220 to about 275° F. under pressure. The recirculation pump was activated and the cleaning composition recirculated through the kier and all of the re-circulation lines of the kier, for a period of about 30 to 745 minutes, causing large amounts of foam to form and filter throughout the system. The pump was then turned-off and the solution cooled to a temperature of about 180° F., at which time the solution was dropped. Rinse water was then added to the kier at a temperature of from about 100°–120° F. and dropped. An acetic acid solution having a pH of about 4.5 was then added to the kier and recirculated at a temperature of about 100° F., for approximately 10 minutes, in order to remove (neutralize) any residual caustic soda still present in the machine.

What is claimed is:

1. A cleaning additive comprising:

(a) from about 8 to about 16% by weight of a nonionic sugar surfactant selected from the group consisting of alkyl glucose esters, aldobionamides, gluconamides, glyceramides, glyceroglycolipids, polyhydroxy fatty acid amides, an alkyl polyglycoside of formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof, (b) from about 3 to about 7% by weight of a $C_8$–$C_{16}$ quaternary ammonium salt;

(c) from about 5 to about 10% by weight of a polyethylene glycol ethoxylated with from about 8 to about 12 moles of ethylene oxide; and (d) remainder water, all weights being based on the weight of the additive.

2. The additive of claim 1 wherein the nonionic sugar surfactant is an alkyl polyglycoside.

3. The additive of claim 2 wherein in formula I $R_1$ is a monovalent organic radical having from 8 to 16 carbon atoms, b is zero, and a is a number having a value of 1.6.

4. The additive of claim 1 wherein the additive contains about 12.0% by weight of the nonionic sugar surfactant, based on the weight of the additive.

5. The additive of claim 1 wherein the nonionic sugar surfactant is a polyhydroxy fatty acid amide.

6. The additive of claim 1 wherein component (b) is a cocodimethyl ammonium chloride.

7. The additive of claim 1 wherein the additive contains about 5.0% by weight of component (b), based on the weight of the additive.

8. A cleaning composition for cleaning interior surfaces of a textile treating apparatus, the composition comprising:

(a) a cleaning additive containing:

(i) from about 8 to about 16% by weight of a nonionic sugar surfactant selected from the group consisting of alkyl glucose esters, aldobionamides, gluconamides, glyceramides, glyceroglycolipids, polyhydroxy fatty acid amides, an alkyl polyglycoside of formula I:

$$R_1O(R_2O)_b(Z)_a \quad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(ii) from about 3 to about 7% by weight of a $C_8$–$C_{16}$ quaternary ammonium salt; and (iii) remainder water, all weights being based on the weight of the additive;

(b) an alkali compound;

(c) from about 5 to about 10% by weight of a polyethylene glycol ethoxylated with from about 8 to about 12 moles of ethylene oxide; and (d) water, wherein the ratio by weight of components (a):(b):(c) is in the range of from about 1:1:25 to about 1:1:50.

9. The composition of claim 8 wherein the nonionic sugar surfactant is an alkyl polyglycoside.

10. The composition of claim 9 wherein in formula I $R_1$ is a monovalent organic radical having from 8 to 16 carbon atoms, b is zero, and a is a number having a value of 1.6.

11. The composition of claim 8 wherein the additive contains about 12.0% by weight of the nonionic sugar surfactant, based on the weight of the additive.

12. The composition of claim 8 wherein the nonionic sugar surfactant is a polyhydroxy fatty acid amide.

13. The composition of claim 8 wherein component (a)(ii) is a cocodimethyl ammonium chloride.

14. The composition of claim 8 wherein the additive contains about 5.0% by weight of component (a)(ii), based on the weight of the additive.

15. A cleaning additive comprising:

(a) from about 8 to about 16% by weight of a polyhydroxy fatty acid amide;

(b) from about 3 to about 7% by weight of a $C_8$–$C_{16}$ quaternary ammonium salt; and (c) remainder water, all weights being based on the weight of the additive.

16. The additive of claim 15 wherein the additive contains about 12.0% by weight of the polyhydroxy fatty acid amide, based on the weight of the additive.

17. The additive of claim 15 wherein component (b) is a cocodimethyl ammonium chloride.

18. The additive of claim 15 wherein the additive contains about 5.0% by weight of component (b), based on the weight of the additive.

19. The additive of claim 15 further comprising the presence of from about 5 to about 10% by weight of a polyethylene glycol ethoxylated with from about 8 to about 12 moles of ethylene oxide, based on the weight of the additive.

20. A process for cleaning interior surfaces of a textile treating apparatus comprising contacting the interior surfaces of the textile treating apparatus with a cleaning composition in order to remove any dyes and other contaminants from the surfaces, the composition comprising:

(a) a cleaning additive containing:

(i) from about 8 to about 16% by weight of a nonionic sugar surfactant selected from the group consisting of alkyl glucose esters, aldobionamides, gluconamides, glyceramides, glyceroglycolipids, polyhydroxy fatty acid amides, an alkyl polyglycoside of formula I:

$$R_1O(R_2O)_b(Z)_a \quad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(ii) from about 3 to about 7% by weight of a $C_8$–$C_{18}$ quaternary ammonium salt; and (iii) remainder water, all weights being based on the weight of the additive;

(b) an alkali compound; and (c) water, the ratio by weight of components (a):(b):(c) ranging from about 1:1:25 to about 1:1:50.

21. The process of claim 20 wherein the nonionic sugar surfactant is an alkyl polyglycoside.

22. The process of claim 21 wherein in formula I $R_1$ is a monovalent organic radical having from 8 to 16 carbon atoms, b is zero, and a is a number having a value of 1.6.

23. The process of claim 20 wherein the additive contains about 12.0% by weight of the nonionic sugar surfactant, based on the weight of the additive.

24. The process of claim 20 wherein the nonionic sugar surfactant is a polyhydroxy fatty acid amide.

25. The process of claim 20 wherein component (a)(ii) is a cocodimethyl ammonium chloride.

26. The process of claim 20 wherein the additive contains about 5.0% by weight of component (a)(ii), based on the weight of the additive.

27. The process of claim 20 wherein the cleaning additive further comprises from about 5 to about 10% by weight of a polyethylene glycol ethoxylated with from about 8 to about 12 moles of ethylene oxide, based on the weight of the additive.

* * * * *